United States Patent [19]

Ferri et al.

[11] Patent Number: 4,781,575

[45] Date of Patent: Nov. 1, 1988

[54] TEMPERATURE COMPENSATOR FOR PRESSURE OPERATED FUEL REGULATOR

[75] Inventors: John L. Ferri; William C. Fulkerson; Ray L. Newman; Jeffrey M. Gonzalez, all of Towanda, Pa.

[73] Assignee: GTE Products Corporation, Stamford, Conn.

[21] Appl. No.: 556,766

[22] Filed: Dec. 1, 1983

[51] Int. Cl.[4] ..... F23N 5/04

[52] U.S. Cl. ..... 431/90; 236/93 R

[58] Field of Search ..... 236/93 R, 92 C, 66, 236/15 BD, 80 R, 92 A; 431/90, 89, 36, 37; 137/98, 100; 138/45, 46

[56] References Cited

U.S. PATENT DOCUMENTS

| | | | |
|---|---|---|---|
| 1,848,031 | 3/1932 | Spencer | 236/93 R X |
| 1,972,169 | 9/1934 | Spencer | 236/92 C |
| 1,972,170 | 9/1934 | Spencer | 236/92 C |
| 1,972,171 | 9/1934 | Spencer | 236/92 C |
| 1,972,907 | 9/1934 | Shaw | 236/93 R X |
| 2,147,568 | 2/1939 | Barber | 137/98 X |
| 2,505,321 | 4/1950 | Brutocao et al. | 236/92 C X |
| 2,677,501 | 5/1954 | Raymond et al. | 138/46 X |
| 2,715,420 | 8/1955 | Stearns | 138/45 |
| 3,154,248 | 10/1964 | Fulton et al. | 236/92 C X |
| 3,592,574 | 7/1971 | Zenkner | 431/90 |
| 4,339,075 | 7/1982 | Schitter et al. | 236/93 R X |
| 4,385,887 | 5/1983 | Yamamoto et al. | 431/90 |
| 4,457,694 | 7/1984 | Maeda et al. | 236/92 A X |

*Primary Examiner*—William E. Tapolcai

*Attorney, Agent, or Firm*—James Theodosopoulos

[57] ABSTRACT

A compensator for a pressure operated fuel regulator comprises a housing having an opening for bleeding air therethrough. There is a tapered plug in the opening fastened to a thermostatic metal within the housing. When the thermostatic metal is heated by incoming air, the clearance around the plug in the opening increases, and the amount of air bleeding out of the opening increases.

6 Claims, 1 Drawing Sheet

TEMPERATURE COMPENSATOR FOR PRESSURE OPERATED FUEL REGULATOR

This invention is concerned with the control of fuel-/air ratios for burners by the use of pressure operated regulators. Such regulators adjust the rate of flow of fuel in accordance with variations in the combustion air flow to the burner. This invention is particularly concerned with a compensator for such regulators that compensates for variations in the temperature of the air supplied to the burner.

The recent increasing use of heat recuperation for energy conservation purposes has resulted in an increasing number of systems in which the air supplied to the burner has been preheated by a heat recuperator. In the prior art, controls for such systems generally operated off the ambient air line, that is to say, the prerecuperator air line. Two problems can occur with such controls. First, they do not compensate for variations that may occur in the temperature of the air exiting the recuperator. Second, they do not allow for leaks that may occur within the recuperator where air may leak directly into the exhaust line without flowing into the burner.

This invention discloses a compensator that compensates for variations in the temperature of air supplied to a burner. Furthermore, when installed in the postrecuperator air line, the compensator also compensates for air that leaks into the exhaust line within the recuperator.

A compensator in accordance with this invention comprises a housing having an opening for bleeding air therethrough. There is a tapered plug in the opening which is fastened to a thermostatic metal within the housing. The cross sectional area of the plug is less than the area of the opening, the clearance around the plug being a free flow area through which air bleeds out of the compensator. The thermostatic metal is heated by the air entering the compensator. When the temperature of the air increases, the thermostatic metal is heated and deflected, thereby displacing the plug within the opening and increasing the free flow area. As a result, more air is bled out of the compensator, thereby increasing the pressure drop across the compensator.

Figure 1:
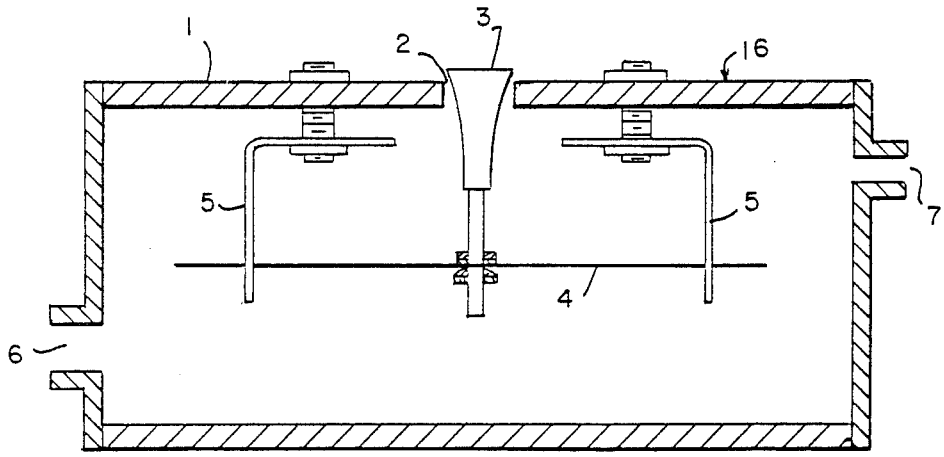
FIG. 1 shows one example of a compensator in accordance with this invention.

As shown in FIG. 1, one example of a compensator in accordance with this invention comprises a housing 1 having an opening 2 therethrough with a tapered plug 3 extending into opening 2. Plug 3 is attached to thermostatic metal strip 4 disposed within housing 1. Metal strip 4 is supported near its ends by supports 5. Housing 1 has an air inlet 6 and an outlet 7. Air pressure delivered to the compensator at inlet 6 is reduced because of air bleeding out of opening 2 around plug 3. Thus, the air pressure delivered to outlet 7 is less than the inlet pressure and is a function of the free flow area around plug 3 which, because of the tapered shape of plug 3, is a function of the amount of deflection of metal strip 4 which, in turn, is a function of the temperature of the air entering inlet 6.

Figure 2:
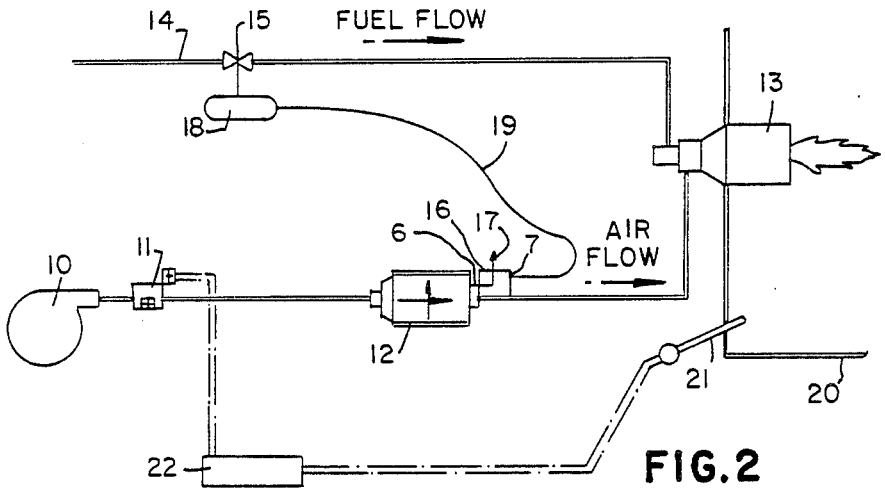
FIG. 2 is a schematic of a system in which the compensator can be used.

In the system shown in FIG. 2, blower 10 blows combustion air through air control valve 11 and through heat recuperator 12 to burner 13. Fuel enters through supply line 14 and passes through fuel control valve 15 to burner 13: A compensator 16 as per this invention is located so that the air supplied to inlet 6 of compensator 16 is heated combustion air from recuperator 12. Air is bled out of compensator 16 as shown at arrow 17. The pressure at outlet 7 of compensator 16 is delivered to regulator 18 through line 19. Regulator 18 regulates control valve 15. In operation the temperature in furnace 20 is sensed by pyrometer 21 and is controlled by temperature controller 22. Air control valve 11 is controlled by temperature controller 22.

In one embodiment, compensator 16 comprised a metal pipe 2¼ inches in diameter by 6 inches long. Opening 2 was a ⅜ inch diameter hole. Plug 3 was made of metal and tapered from a maximum diameter of 368 mils to a minimum diameter of about 230 mils for the operative portion thereof. Metal strip 4 comprised Chace bimetal #4000, 15 mils thick by 1 inch wide by 5 inches long overall, 4 inches long in working length (between supports 5). Metal strip 4 was not attached to supports 5 but merely rested thereon, extending through slots in supports 5. Inlet 6 was ¼ inch inside diameter. The diameter of outlet 7 was also ¼ inch, but its size is immaterial because there is no air flow thereat, the operation of regulator 18 being controlled merely by the pressure at outlet 7.

When the air entering inlet 6 was at a temperature of 200° F., the plug diameter within opening 2 was 340 mils and the free flow area around the plug was 0.020 square inches. At an inlet air temperature of 600° F., the plug diameter was 290 mils and the free flow area was 0.044 square inches. The respective measurements at inlet air temperature of 1200° F. were 240 mils and 0.066 square inches. The maximum deflection of bimetal 4 during these tests was about ¾ inch.

Measurements were also made on this embodiment of the pressure drop across compensator 16 at several inlet air temperatures. At an air inlet temperature of 301° F., the pressure drop was 15.4 inches water column; the pressure at inlet 6 was 15.4 inches and at outlet 7, 10.0 inches. At air inlet temperature of 604° F., the pressure drop was 9.0 inches; the pressure at inlet 6 was 18.2 inches and at outlet 7, 9.2 inches. At air inlet temperature of 1103° F., the pressure drop was 14.6 inches; the pressure at inlet 6 was 22.5 inches and at outlet 7, 7.9 inches.

The amount of air bleeding out of opening 2 of compensator 16 during operation is insignificant, being a maximum of only about 100 cubic feet per hour, at a preheated air flow to burner 13 of about 5,000 to 10,000 cubic feet per hour.

We claim:

1. A compensator for a pressure fuel regulator comprising a housing having an opening for bleeding air therethrough, a tapered plug in the opening fastened to a thermostatic metal within the housing, there being clearance around the plug within the opening, said clearance being a free flow area, the free flow area increasing in area when the thermostatic metal is heated, the thermostatic metal comprising an elongated metal strip which is not attached to any support but the ends of which extend through slots of supports within the housing, the metal strip merely resting on the supports.

2. The compensator of claim 1 wherein said housing has inlet for introducing air into the housing.

3. The compensator of claim 2 wherein said housing has an outlet for delivering pressure to said fuel regulator.

4. The compensator of claim 3 wherein, during operation, air bleeds out of said opening and causes a pressure drop between said inlet and said outlet.

5. The compensator of claim 4 wherein said pressure drop is a function of the temperature of the air entering said inlet.

6. The combination of a pressure operated fuel regulator and a compensator for the pressure operated fuel regulator, the compensator comprising a housing having an opening for bleeding air therethrough, a tapered plug in the opening fastened to a thermostatic metal within the housing, there being clearance around the plug within the opening, said clearance being a free flow area, the free flow area increasing in area when the thermostatic metal is heated, the thermostatic metal comprising an elongated metal strip which is not attached to any support but the ends of which extend through slots of supports within the housing, the metal strip merely resting on the supports.

* * * * *